US005887722A

United States Patent [19]

Albrecht et al.

[11] Patent Number: 5,887,722

[45] Date of Patent: Mar. 30, 1999

[54] BANDOLEER PACKAGING WITH EDGE HEAT SEALED TO BACKING

[75] Inventors: Jeffrey A. Albrecht, Silver Lake; Hector L Vega, Oak Creek; Donald A. Guth, Algoma, all of Wis.

[73] Assignee: American Creative Packaging, Oak Creek, Wis.

[21] Appl. No.: 878,308

[22] Filed: Jun. 18, 1997

[51] Int. Cl.[6] ..... B65D 85/00; B65D 75/00; B65D 35/54

[52] U.S. Cl. ..... 206/714; 206/820; 206/526; 53/450; 53/157

[58] Field of Search ..... 53/445, 450, 415, 53/157; 383/37, 38; 206/526, 725, 714, 820

[56] References Cited

U.S. PATENT DOCUMENTS

| | | | |
|---|---|---|---|
| 1,795,049 | 3/1931 | Shaffer . | |
| 2,047,745 | 7/1936 | Poppe . | |
| 2,095,437 | 10/1937 | Fox . | |
| 2,142,194 | 1/1939 | Karfiol . | |
| 2,154,521 | 4/1939 | Maxfield . | |
| 2,194,451 | 3/1940 | Soubier . | |
| 2,260,064 | 10/1941 | Stokes . | |
| 2,294,220 | 8/1942 | Albertson . | |
| 2,323,342 | 7/1943 | McManus et al. . | |
| 2,347,509 | 4/1944 | Salfisberg | 53/415 |
| 2,417,497 | 3/1947 | Hulslander, Sr. . | |
| 2,636,297 | 4/1953 | Johnson . | |
| 2,714,557 | 8/1955 | Mahaffy . | |
| 2,732,065 | 1/1956 | Marchese . | |
| 2,796,982 | 6/1957 | Volckening . | |
| 2,832,712 | 4/1958 | Deinlein et al. . | |
| 3,143,276 | 8/1964 | Nichols . | |
| 3,191,849 | 6/1965 | Gutowski et al. . | |
| 3,199,756 | 8/1965 | Davy . | |
| 3,214,080 | 10/1965 | Wolfson . | |
| 3,224,640 | 12/1965 | Schneider et al. . | |
| 3,267,623 | 8/1966 | Block . | |
| 3,286,831 | 11/1966 | Giberstein . | |
| 3,304,843 | 2/1967 | Cloud, Jr. . | |
| 3,411,978 | 11/1968 | Frohbach et al. . | |
| 3,485,349 | 12/1969 | Chaney, Jr. . | |
| 3,503,568 | 3/1970 | Galley . | |
| 3,524,271 | 8/1970 | Buske . | |
| 3,532,574 | 10/1970 | Davis . | |
| 3,556,292 | 1/1971 | Krzyzanowski . | |
| 3,561,332 | 2/1971 | Ross . | |
| 3,696,580 | 10/1972 | Saltzer, Sr. | 53/450 |
| 3,784,086 | 1/1974 | Forbes, Jr. . | |
| 3,785,895 | 1/1974 | Ettre et al. . | |
| 3,844,409 | 10/1974 | Bodolay et al. . | |
| 4,157,410 | 6/1979 | Mc Clintock . | |

(List continued on next page.)

FOREIGN PATENT DOCUMENTS

| | | | |
|---|---|---|---|
| 1355655 | 6/1974 | United Kingdom | 53/324 |

*Primary Examiner*—Paul T. Sewell
*Assistant Examiner*—Jila Mohandesi
*Attorney, Agent, or Firm*—Eugene Stephens & Associates

[57] ABSTRACT

A bandoleer package and method for the making thereof in which bandoleer packages can be used to hold objects that are dimensioned or relatively thick without the usual risk of damage to the object caused by burst rollers. The preferred embodiment is made by forming a tube from a first web around a card cut from a secondary web and an object to be packaged, heat sealing the tube to itself to form a bottom seam of the package and a top seam of a previous package, then bonding the edges of the tube to the card. By bonding the edges to the card, the dimensioned object is kept away from the edges, thus preventing crushing of the object by burst rollers. The second web is preferably coated with a material that facilitates bonding to the first web material. In the preferred embodiment, the first web and the coating are formed from resinous materials, such as polyethylene; but any suitable materials can be used. In another embodiment, the bandoleer package includes an adhesive stripe covered by an unperforated release liner. The packages can be automatically affixed to a substrate upon removal of the release liner and bursting of the bandoleer.

34 Claims, 2 Drawing Sheets

U.S. PATENT DOCUMENTS 4,168,779 9/1979 Yokokoji et al. .
4,268,344 5/1981 Jones .
4,281,762 8/1981 Hattemer .
4,298,158 11/1981 Hoppe et al. .
4,306,656 12/1981 Dahlem .
4,344,557 8/1982 Lerner .
4,359,358 11/1982 Hattemer .
4,401,213 8/1983 Lerner .
4,433,783 2/1984 Dickinson .
4,512,472 4/1985 Järund .
4,529,636 7/1985 Olson .
4,537,586 8/1985 Gale et al. .
4,550,831 11/1985 Whitford .
4,564,108 1/1986 Widlund et al. .
4,604,153 8/1986 Melbye .
4,621,732 11/1986 Olson .
4,631,905 12/1986 Maloney .
4,674,129 6/1987 Janhonen .
4,684,018 8/1987 Järund .
4,694,959 9/1987 Ausnit et al. .
4,726,970 2/1988 Morrish et al. .
4,735,316 4/1988 Fröidh et al. .
4,744,673 5/1988 Nakamura .
4,779,400 10/1988 Hoskinson et al. .
4,790,433 12/1988 Raszewsi ..... 53/450
4,854,109 8/1989 Pinarer et al. .
4,859,083 8/1989 Nocek et al. .
4,863,285 9/1989 Claxton .
4,863,772 9/1989 Cross .
4,972,657 11/1990 McKee .
4,999,968 3/1991 Davis .
5,025,923 6/1991 Okui .
5,027,583 7/1991 Chelak .
5,118,202 6/1992 Bruno .
5,184,724 2/1993 Mayled .
5,281,455 1/1994 Braun et al. .
5,298,104 3/1994 Absher .
5,334,431 8/1994 Longtin .
5,363,966 11/1994 Czech et al. .
5,369,936 12/1994 Callahan et al. .
5,611,430 3/1997 Albrecht et al. .

BANDOLEER PACKAGING WITH EDGE HEAT SEALED TO BACKING

TECHNICAL FIELD

Our invention relates to the field of bandoleer packaging. More specifically, we have invented a new form of bandoleer packaging that can accommodate dimensioned or relatively thick items yet allows the individual packages to be separated using a roller-type bursting mechanism. Further, our new bandoleer packaging can include an adhesive stripe to allow automated attachment of individual packages to substrates.

BACKGROUND OF THE INVENTION

Bandoleer packaging generally includes a tube formed from a primary web into which items are inserted. The individual packages are typically formed by heat sealing top and bottom seams or edges of the packages along the tube. A perforation or other weakening is generally placed between the top edge of one package and the adjacent bottom edge of another package to ease separation of the packages from the bandoleer. One way to separate packages from a bandoleer is to run the bandoleer through a bursting mechanism. Burst mechanisms generally include rollers that engage the edges of the bandoleer and put tension on the bandoleer to pull packages off the end of the bandoleer.

Bandoleer packages separated by bursting mechanisms are generally limited to flat contents to avoid damage to the contents. Dimensioned objects tend to travel within the individual packages before entering the burst station. When the packages pass through the burst mechanism, dimensioned objects that have traveled toward the edges of the packages can be damaged or destroyed by the burst rollers.

Packages similar to individual bandoleer packages have been affixed to the exterior of larger packages or other substrates for various purposes. Although bandoleers are convenient for the production of such individual packages, prior art bandoleer packages must be individually separated and glued to the larger packages. This is generally too time consuming and labor intensive to be sustained for high levels of production.

SUMMARY OF THE INVENTION

Our invention provides inserts in bandoleer packages to which we bond the edges of each package, keeping the objects contained within the packages away from the edges of the packages. We prefer to provide an insert in the form of a card that has been treated with a coating that is heat sensitive, allowing us to bond the edges with heat-sealing equipment. By bonding the edges of the packages to the cards, we hold the contents far enough away from the edges that a burst mechanism can separate the packages without damaging the contents. While our invention can be used with any type of bandoleer packaging, we have designed our invention for preferred use with bandoleers made by forming a tube from the primary web.

In the preferred embodiment of our invention, the tube is formed around the secondary web and the dimensioned or relatively thick object to be packaged. We then form two seams with a perforation therebetween, one seam being the top of one package and the other being the bottom of an adjacent package. Next, we bond the edges of the packages to the secondary web, thereby confining the contents of the packages to a region far enough away from the edges of the tube as to avoid damage when the bandoleer is fed through bursting rollers.

In another embodiment of our invention, we provide an adhesive stripe to our bandoleer package in such a way that the individual packages can be separated and affixed to larger packages or other substrates automatically. The adhesive stripe can be placed on the bandoleer before or after perforations are formed between individual packages of the bandoleer. We place a release liner that is preferably unperforated over the stripe to protect the adhesive and prevent the bandoleer packages from adhering to items other than those to which they are to be affixed. The bandoleer can then be fed through an automated application machine to a separating station that separates the release liner from the bandoleer tube. The individual packages are then disconnected from the bandoleer along the perforations and affixed to the larger packages or other substrates.

DESCRIPTION OF THE INVENTION

Our method 100 is particularly suited for use with modern automated packaging machinery. This type of machinery generally uses webs in the form of rolls to form bandoleers 1. There are many stations in the machinery, such as rolling, shaping, cutting, and bonding stations.

Figure 1:
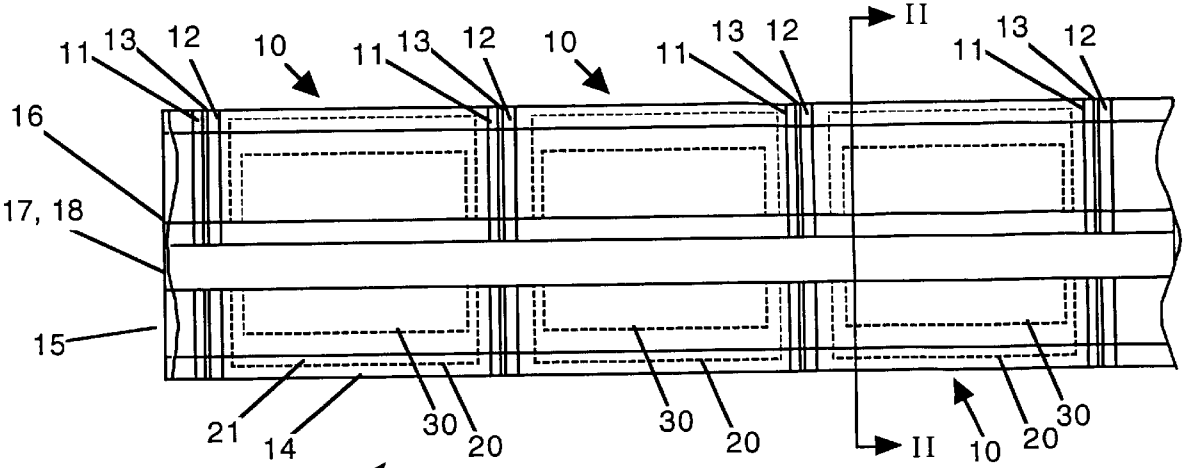
FIG. 1 is a schematic view of a portion of a bandoleer made according to our invention.
Figure 2:
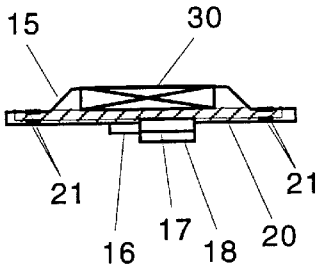
FIG. 2 is a cross section of an individual package along the line II—II in FIG. 1.
Figure 3:
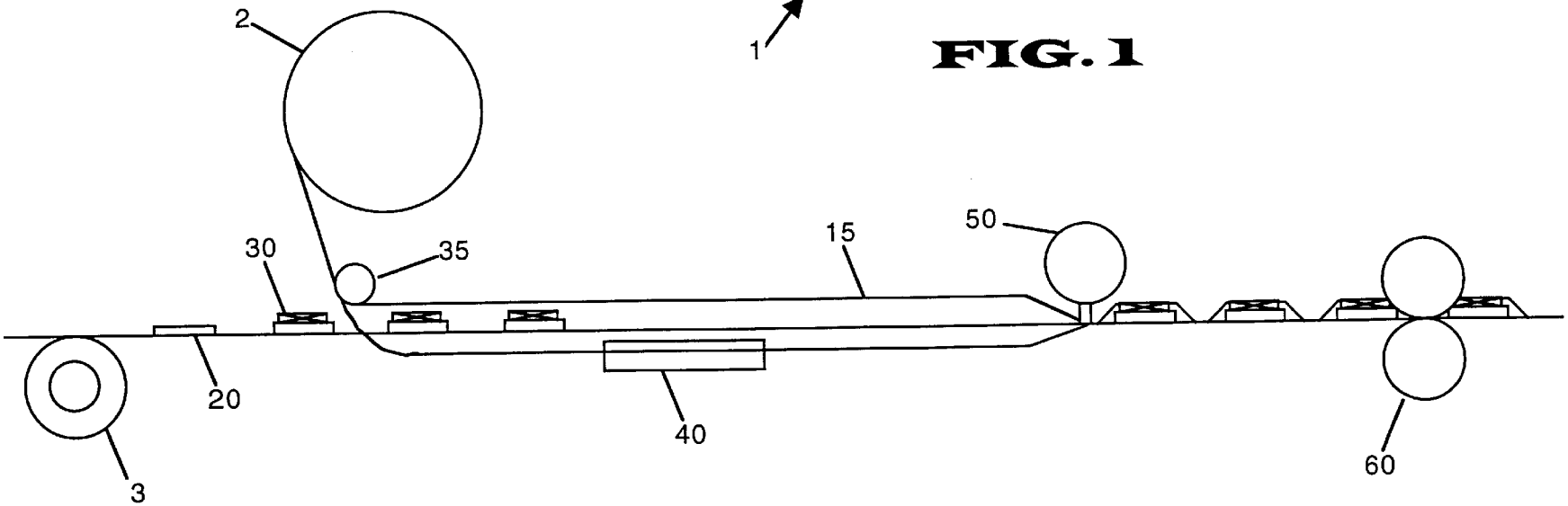
FIG. 3 is a schematic of a bandoleer being assembled according to our invention.
Figure 4:
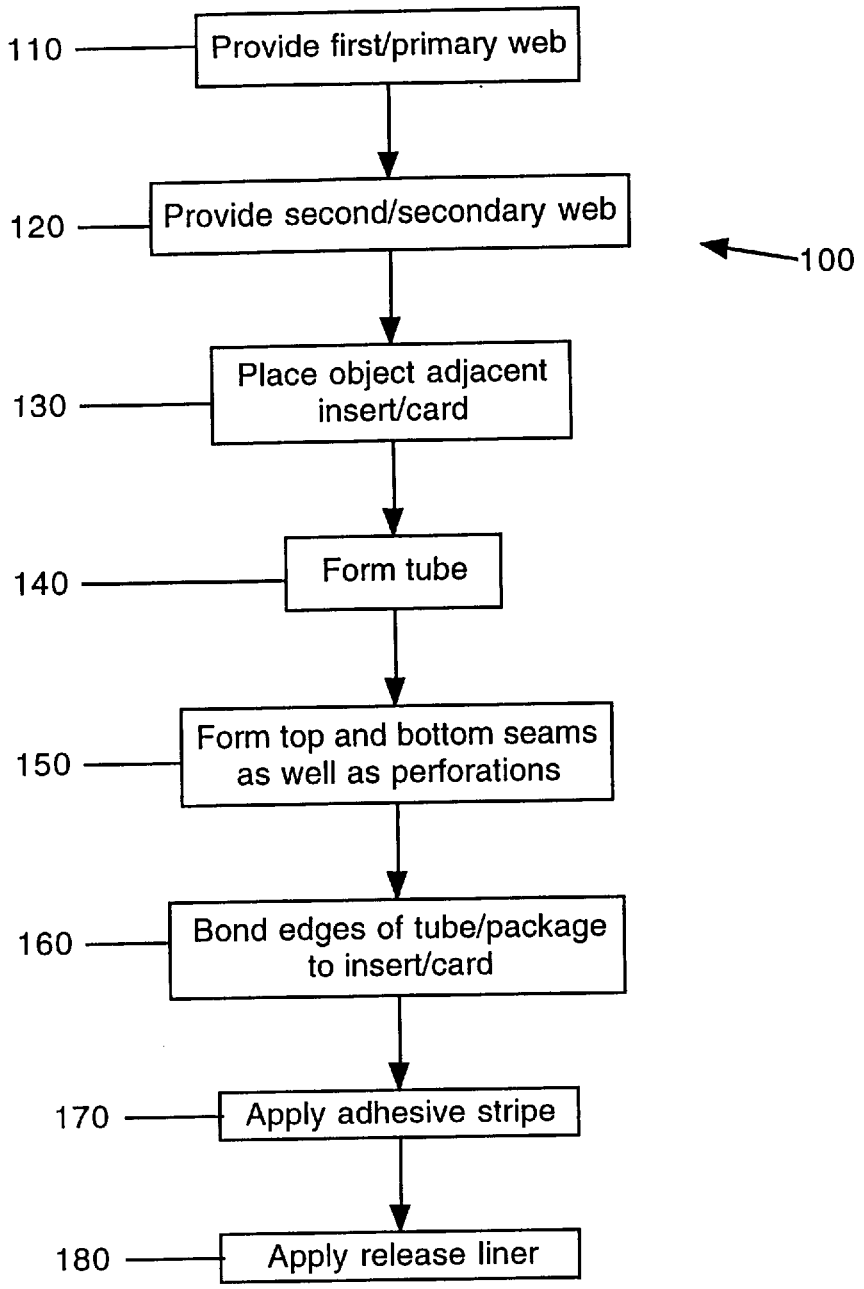
FIG. 4 is a schematic representation of the method of our invention.

We provide and use a primary web 2, as seen particularly in FIG. 3 and as represented by block 110 of FIG. 4, to form a tube 15 from which we form a bandoleer 1 of packages 10 in all embodiments of our invention. The primary web 2 is preferably a resinous material, such as polyethylene, that can be of any suitable dimensions. We also provide and use inserts 20, as represented by block 120 of FIG. 4, preferably in the form of cards made of a relatively rigid material, such as paper card stock. We place an insert 20 adjacent a surface of the primary web 2 or vice versa such that the insert 20 is surrounded by the tube 15. This can be seen in FIG. 3 and is represented by blocks 130 and 140 in FIG. 4. The tube 15 is flattened and acquires edges 14 when we form top and bottom seams 11, 12 for packages 10 in the tube 15 at a seam-forming station 50 (refer to FIGS. 1–3 and block 150 of FIG. 4). Top and bottom seams 11, 12 are also the top and bottom edges of the individual package 10. At a point 60 after the formation of the top seam 11 of a given package 10, we bond the edges 14 of the package 10 to the insert 20 to keep a dimensioned or relatively thick object 30 in the package 10 away from the edges 14 of the package 10. This is represented by block 160 in FIG. 4 and is illustrated in FIGS. 1–3. We prefer to use inserts 20 coated with a heat-sealable material, such as polyethylene, so that we can simply use heat-sealing equipment to bond the edges 14 to the inserts 20. With the edges 14 thus bonded to the inserts 20, the packages 10 can pass through a bursting station with no damage to the objects they contain.

In the preferred embodiment of our invention, inserts 20, preferably in the form of paperboard cards, are placed on a conveyor 3 (block 120). We prefer to place the objects 30 to be packaged on the conveyor 3 with the inserts 20, but the objects 30 can also be placed on the insert 20 after the insert 20 is placed on the conveyor 3 (block 130). Where the objects 30 are placed on the conveyor 3 with the inserts 20, we prefer to attach the objects 30 to the inserts 20 with an adhesive or the like if this will not cause damage to the objects 30. We then pass the primary web 2 through plows 35 to form the tube 15 around the inserts 20 (block 140). The primary web 2 is sealed in the shape of a tube 15 by heated rollers 40 that seal the edges 16 of the primary web 2 together beneath the inserts 20 (block 140). Next, we heat seal the tube 15 to itself to form the perforations 13 between packages at a perfing station 50, at the same time forming the top seam 11 of one package 10 which includes a top edge of the package 10, and the bottom seam 12 of an adjacent or previous package 10 which includes a bottom edge of the previous package 10 (block 150). Then, we bond the edges 14 of the tube 15/packages 10 to the inserts 20 (block 160) at an edge-bonding station 60, preferably by heat sealing the tube material to a coating on the inserts 20 as illustrated by the region 21 in the Figures. We prefer to use polyethylene or polypropylene for the coating, but any suitable material can be used. Once all the seams and edges are formed, we feed the bandoleer 1 of packages 10 into a carton using a transverse fan fold. The bandoleers 1 are run through bursting rollers by the end user, who inserts individual bandoleer packages into his or her product or affixes the individual packages to larger packages as will be described below. For example, cereal manufacturers insert individual packages containing toys into boxes of their cereal. However, having the bursting station at the same place as, or even as part of, the same machinery that forms the bandoleer is within the scope of our invention.

While we prefer to form the tube 15 around the inserts 20 and objects to be packaged 30, the inserts 20 can also be inserted into the tube 15 after the bottom seam 12 of a package 10 is formed. Additionally, it is within the scope of the invention to carry out the step of bonding the edges 14 of the packages 10 to the inserts 20 at the same time as the first and second seams 11, 12 are formed. Further, while the preferred manner of bonding the edges 14 is to heat seal them to a coating on the inserts 20, other forms of bonding are within the scope of the invention as may be appropriate for the circumstances. For example, epoxy or other adhesives might be used to affix the edges to the inserts 20.

An additional feature of our invention provides for automatic affixing of the individual packages 10 to larger packages or other substrates and can be seen in FIGS. 1–4. An adhesive stripe 17 is applied to the bandoleer 1 of packages 10. This can be done before or after the perforations 13 between packages 10 are formed, but is preferably done after formation of the perforations 13, as represented by block 170 in FIG. 4, to avoid exposing the perforation-making equipment 50 to the adhesive. After the perforations 13 are formed and after the adhesive stripe 17 is applied, we place a release liner 18 over the adhesive stripe (block 180). The release liner 18, which is preferably unperforated, protects the adhesive stripe 17 and prevents adherence of the bandoleer 1 to objects other than the larger packages or other substrates to which they are to be affixed. While we prefer to use this feature of our invention with the sealed-edge type of bandoleer packaging, it is within the scope of the invention to apply our adhesive stripe and unperforated release liner to any bandoleer packaging.

When an end user wishes to affix bandoleer packages 10 to larger packages, the bandoleer 1 is run through an automated application machine to a separating station that separates the release liner 18 from the bandoleer tube 1. The individual packages 10 are then disconnected from the bandoleer 1 along the perforations 13 and affixed to the larger packages or other substrates at another station. These stations could, for example, be incorporated into the machinery shown in FIG. 3.

Since the packages 10 already have adhesive applied, and since the packages can be automatically affixed to larger packages or other substrates, high levels of production are achieved with low cost as compared to manually affixing similar packages. Because the release liner 18 is unperforated, it can be easily controlled and disposed of during and after removal from the bandoleer 1, saving on clean-up costs as well.

As mentioned above, our invention can be formed and our method performed using existing machinery, though the machinery must be modified to accommodate the bonding of the package edges, the removal of the release liner, and the affixing of the packages to larger packages or other substrates. Where the edges are bonded using heat sealing, the modification entails adding heat-sealing elements to an existing station or adding a new heat-sealing station. Where the bonding is accomplished using an adhesive compound, such as epoxy, the modification entails the addition of adhesive-application equipment. Other modifications for other methods of bonding are within the scope of the invention as well.

While our invention is intended for use with dimensioned objects, it should be apparent that our invention could be applied to the packaging of flat objects as well.

| Parts List | |
|---|---|
| 1 | Bandoleer of packages |
| 2 | Primary web |
| 3 | Conveyor |
| 10 | Package |
| 11 | Top/first seam of package |
| 12 | Bottom/second seam of package |
| 13 | Perforation between packages |
| 14 | Edge of tube/package |
| 15 | Tube (formed by folding and sealing of primary web) |
| 16 | Edge of primary web |
| 17 | Adhesive stripe |
| 18 | Release liner |
| 20 | Inserts/cards |
| 21 | Region of bond between edges 14 and cards 20 |
| 30 | Objects to be packaged/dimensioned objects |
| 35 | Plows for manipulating primary web into shape of tube |
| 40 | Heat-sealing station/heated rollers for joining edges of tube |
| 50 | Perforation-forming (perfing) station (also forms top and bottom seams of packages) |
| 60 | Edge-bonding station |
| 100 | Schematic representation of inventive method |
| 110 | Provide primary web |
| 120 | Provide inserts/cards |
| 130 | Place object to be packaged adjacent insert/card |
| 140 | Form tube |
| 150 | Form top/first and bottom/second seams and perforations |
| 160 | Bond edges of tube/package to insert/card |
| 170 | Apply adhesive stripe |
| 180 | Apply release liner |

We claim:

1. A method of making bandoleer packages for dimensioned objects such that the risk of damage to the objects from burst rollers is substantially eliminated, the method comprising the steps of:

A. Providing a primary web of material;

B. Providing a plurality of inserts made from a substantially relatively rigid material;

C. Placing a dimensioned object adjacent a respective insert, the object to be contained in a current package;

D. Forming a flattened tube from the primary web that surrounds the insert and the object, the flattened tube having edges;

E. Forming a top seam of a previous package downstream of the object and the insert, a bottom seam of the current package being formed by the formation of the top seam of the previous package thus forming a bandoleer of packages; and F. Bonding the tube to the insert on either side of the object in order to maintain the object in a position that is away from the edges of the flattened tube, thereby protecting the object against damage from burst rollers.

2. The method of claim 1 wherein the primary web of material is a web of a resinous material and the step of forming a bottom seam and a top seam includes the sub-step of heat sealing the flattened tube to form the bottom and top seams.

3. The method of claim 1 wherein the step of bonding the tube to the insert comprises the sub-step of heat sealing the edges of the flattened tube to the insert.

4. The method of claim 1 wherein the inserts are coated with a coating that will bond the edges of the flattened tube to the inserts.

5. The method of claim 4 wherein the coating is a resinous material.

6. The method of claim 5 wherein the primary web is made of a resinous material and the edges of the flattened tube are heat sealed to the coating of the insert.

7. The method of claim 1 further comprising the steps of:

applying a stripe of adhesive to the bandoleer of packages; and applying a release liner to the stripe of adhesive.

8. A method of making a bandoleer of packages containing dimensioned objects with substantially no risk of damage to the objects from burst rollers, the method comprising the steps of forming the bandoleer of packages and bonding edges of the packages to cards contained therein, thereby confining the dimensioned objects in respective packages away from the edges of the bandoleer of packages.

9. The method of claim 8 wherein the bandoleer is formed from a primary web and the cards are formed from a secondary web.

10. The method of claim 9 wherein the primary web is wrapped around the cards and the objects of the packages to form a tube.

11. The method of claim 10 wherein the primary web is a resinous material and edges of the primary web are heat sealed together to form the tube.

12. The method of claim 11 wherein the packages are formed by heat sealing the tube to itself to form top seams, bottom seams, and perforations therebetween.

13. The method of claim 8 wherein the primary web is a first resinous material and the cards are coated with a second resinous material, the step of bonding the edges of the tube comprising the sub-step of heat sealing the edges of the tube to the coating.

14. The method of claim 13 wherein the first and second resinous materials are the same material.

15. The method of claim 13 wherein the second resinous material is polyethylene.

16. The method of claim 8 further comprising the steps of applying a stripe of adhesive to the bandoleer and applying a release liner to the stripe of adhesive.

17. A bandoleer of packages containing dimensioned objects that are substantially safe from damage from burst rollers used to separate the packages from the bandoleer, the bandoleer of packages comprising:

a tube formed from a primary web;

edges of the tube being bonded to inserts contained within the tube to form a bonded area on each edge that is substantially approximately a width of a burst roller, the inserts being made from a substantially relatively rigid material, the edges of the tube also comprising edges of the packages and of the bandoleer, the bonded edges thereby keeping dimensioned objects contained in the packages away from the edges of the bandoleer and packages;

a top seam and bottom seam of each package being formed substantially between inserts by flattening and bonding the tube to itself at predetermined locations; and a perforation being formed between the top seam of one package and the bottom seam of the next.

18. The bandoleer of claim 17 wherein each package comprises:

a body of the package formed from the primary web, the body including portions of the edges of the bandoleer;

an insert in the form of a card contained within the body of the package, the edges of the body of the package being bonded to the card; and a dimensioned object between one surface of the card and one surface of the body of the package, the object being kept away from the edges of the body of the package by virtue of the edges of the body being bonded to the card and thereby preventing damage to the object from burst rollers.

19. The bandoleer of claim 18 wherein the primary web is a resinous material and the edges of the tube are bonded to the inserts by heat sealing the edges of the tube to a coating on the cards.

20. The bandoleer of claim 17 wherein:

the inserts are coated with a resinous material;

the primary web is a resinous material;

the top seam and bottom seam are formed by heat sealing the tube to itself; and the edges of the tube are bonded to the inserts by heat sealing.

21. The bandoleer of claim 17 further comprising:

an adhesive stripe applied to a length of the bandoleer after formation of the seams and perforations between packages; and a release liner covering the adhesive stripe.

22. A method of making a bandoleer of packages for dimensioned objects so that the packages can be automatically affixed to a substrate and so that risk of damage from burst rollers is substantially eliminated, the method comprising the steps of:

A. Providing a primary web;

B. Wrapping the primary web around an object to be packaged and joining edges of the primary web to form a tube;

C. Forming a top seam of a previous package and a bottom seam for a current package substantially between respective objects to be packaged contained therein;

D. Weakening the primary web between the top seam of the previous package and the bottom seam of the current package to decrease a force required to separate the previous package from the current package;

E. Applying adhesive along a length of a respective package to form a stripe of adhesive along the bandoleer; and F. Applying a release liner to the adhesive stripe along the bandoleer after the step of weakening the primary web between the top seam of the previous package and the bottom seam of the current package, the release liner thus remaining unperforated.

23. The method of claim 22 further comprising the step of placing the object to be packaged of a package adjacent a respective insert.

24. The method of claim 23 wherein the inserts are cards and each object to be packaged is placed adjacent a surface of a respective card.

25. The method of claim 23 wherein the primary web is made of a first resinous material and the edges of the primary web are joined by heat sealing.

26. The method of claim 25 wherein the step of forming the top and bottom seams includes the sub-step of heat sealing the tube to itself at desired locations.

27. The method of claim 23 further including the step of bonding the edges of the current package to the insert.

28. The method of claim 27 wherein the primary web in made of a first resinous material and the inserts are coated with a second resinous material.

29. The method of claim 28 wherein the step of bonding the edges of the current package to the insert includes the sub-step of heat sealing the edges of the package to the insert.

30. A bandoleer of packages comprising:

a tube formed from a primary web;

an adhesive stripe applied to the tube along a length of the tube;

an unperforated release liner applied to the adhesive stripe;

a top seam and bottom seam of each package being formed by flattening and bonding the tube to itself at predetermined locations; and a perforation being formed between the top seam of one package and the bottom seam of the next, the seams and perforation being formed before application of the release liner, thereby avoiding perforation of the unperforated release liner so that the unperforated release liner remains unperforated, whereby the individual packages can be affixed to a substrate automatically.

31. The bandoleer of claim 30 wherein:

edges of the tube are bonded to inserts contained within the tube, the edges of the tube also comprising edges of the packages and of the bandoleer, the bonded edges thereby keeping dimensioned objects contained in the packages away from the edges of the bandoleer and packages; and the top seam and bottom seam of each package are formed substantially between inserts.

32. The bandoleer of claim 31 wherein each package comprises:

a body of the package formed from the primary web, the body including portions of the edges of the bandoleer;

an insert in the form of a card contained within the body of the package, the edges of the body of the package being bonded to the card; and a dimensioned object between a surface of the card and a surface of the body of the package, the object being kept away from the edges of the body of the package by virtue of the edges of the body being bonded to the card and thereby preventing damage to the object from burst rollers.

33. The bandoleer of claim 32 wherein the primary web is a resinous material and the edges of the tube are bonded to the inserts by heat sealing the edges of the tube to a coating on the cards.

34. The bandoleer of claim 33 wherein:

the inserts are coated with a resinous material;

the primary web is a resinous material;

the top seam and bottom seam are formed by heat sealing the tube to itself; and the edges of the tube are bonded to the inserts by heat sealing.

* * * * *